United States Patent [19]

Branson et al.

[11] 4,159,800

[45] Jul. 3, 1979

[54] FUEL CONTROL SYSTEM AND CONTROL DEVICE THEREFOR OR THE LIKE

[75] Inventors: Charles D. Branson; Roy C. Demi, both of Greensburg, Pa.

[73] Assignee: Robertshaw Controls Company, Richmond, Va.

[21] Appl. No.: 880,762

[22] Filed: Feb. 24, 1978

Related U.S. Application Data

[60] Continuation of Ser. No. 742,910, Nov. 17, 1976, abandoned, which is a division of Ser. No. 570,863, Apr. 23, 1975, Pat. No. 4,007,872, which is a division of Ser. No. 530,605, Dec. 9, 1974, Pat. No. 3,989,064, which is a continuation-in-part of Ser. No. 443,783, Feb. 19, 1974, abandoned, which is a continuation-in-part of Ser. No. 380,389, Jul. 18, 1973, abandoned.

[51] Int. Cl.[2] ..... F16L 5/00

[52] U.S. Cl. ..... 236/15 A; 285/188

[58] Field of Search ..... 285/189, 188; 236/15 A, 236/99 R

[56] References Cited

U.S. PATENT DOCUMENTS

| | | | |
|---|---|---|---|
| 2,237,199 | 4/1941 | Sherlock | 236/15 A |
| 2,553,340 | 5/1951 | Smith | 285/189 X |
| 3,934,787 | 1/1976 | Fels | 285/189 X |

*Primary Examiner*—William E. Wayner

*Attorney, Agent, or Firm*—Candor, Candor & Tassone

[57] ABSTRACT

A fuel control device having a passage therethrough for interconnecting a fuel source with a main burner and having a poppet valve arrangement that is directly manually operated for opening and closing the passage so as to control the flow of fuel from the source to the main burner, the poppet valve arrangement having a poppet valve member that is moved relative to its valve seat upon the manual manipulation of a selector of the control device. The poppet valve member can work with the pressure of the fuel from the source thereof when the poppet valve member is being moved to its closed position.

4 Claims, 22 Drawing Figures

FUEL CONTROL SYSTEM AND CONTROL DEVICE THEREFOR OR THE LIKE

This application is a Continuation application of its copending parent application, Ser. No. 742,910, filed Nov. 17, 1976, now abandoned, which, in turn, is a Division of its copending parent application, Ser. No. 570,863, filed Apr. 23, 1975, now U.S. Pat. No. 4,007,872, which, in turn, is a Division of its copending parent appliction, Ser. No. 530,605, filed Dec. 9, 1974, now U.S. Pat. No. 3,989,064, which, in turn, is a Continuation-in-Part of its parent copending application, Ser. No. 443,783, filed Feb. 19, 1974, now abandoned which, in turn, is a Continuation-in-Part of its parent copending application, Ser. No. 380,389, filed July 18, 1973, and now abandoned in favor of its said copending Continuation-in-Part application.

This invention relates to an improved fuel control system for a fuel burning apparatus, such as a cooking apparatus or the like and to an improved control device for such a fuel control system or the like.

It is well known to provide a fuel control system for a fluid fuel burning apparatus, such as a cooking apparatus or the like, wherein a passage defining means is provided between a source of fuel and the main burner with the passage defining means having a pair of control devices disposed therein in series relation with the first control device having means for manually opening the passage defining means when the selector of the first control device is moved from an "off" position thereof toward an "on" position thereof. The first control device also has means for thermostatically controlling the flow of fuel to the passage means downstream from the main "on-off" valve means thereof while the second control device has its valve means moved from a closed position thereof to an open position thereof when the second control device senses the presence of a large heater flame at a pilot burner means that is disposed adjacent the main burner, the heater pilot being controlled by the thermostatically operated valve means of the first control device.

In particular, the selector of the first control device sets the thermostatically operated valve means thereof to thermostatically control the flow of fuel to the heater pilot means so that when the output temperature effect of the main burner falls below the selected temperature of the selector of the first control device, the thermostatic valve means of the first control device opens and allows not only fuel to flow through the passage defining means to the second control device, but also allows fuel to flow to the heater pilot to form a large heater flame that is detected by the second control device so that the second control device will open and pass the main flow of fuel on to the main burner to be ignited by the pilot burner means. When the output temperature effect of the main burner exceeds the set temperature setting of the selector of the first control device, the thermostatically operated valve means of the first control device closes and thus prevents fuel from flowing to the heater pilot means so that the heater flame ceases to exist and causes the valve means of the second control device to close and block the passage leading to the main burner.

In this manner, the main burner means can be caused to be cycled on and off to tend to maintain the output temperature effect thereof at the temperature selected by the selector of the first control device.

Such fuel control systems are fully disclosed in the U.S. Pat. Nos. to Wantz et al, 3,132,803 and 3,167,250.

However, it has been found according to the teachings of this invention, that in view of the fact that the pressures of gaseous fuels being supplied through pipe lines to be subsequently piped to the ultimate consumer is increasing in order to supply a greater number of users and over greater distances from sources thereof, a series of pressure regulators must be utilized not only in the utility lines, but also in the consumer's building in order to step down the pressure of such high pressure fuel to a useable pressure level for the desired fuel burning apparatus.

Should such step-down fuel pressure regulator means fail so that a relatively high pressure fuel is being delivered to a particular fuel control system of the above type, the main "on-off" valve member of the first control device must withstand such adverse pressures in order to prevent such high pressure fuel from leaking therethrough and into the fuel control system to create a hazardous condition.

Accordingly, it is a feature of this invention to provide an improved control device of the above type having an improved "on-off" valve means therefor that is believed will tend to withstand such high adverse fuel pressure situations and thereby not permit the aforementioned hazardous fuel leaking situation.

Another feature of this invention is to provide a fuel control system utilizing such a control device or the like.

In particular, one embodiment of the improved control device of this invention has a poppet valve member providing the main "on-off" valve means thereof with such poppet valve member being directly movable between its open and closed positions by the selector means of the control device being moved between its "off" position and a certain "on" position thereof, such selector means also setting a thermostatically operated valve means of such control device. The poppet valve member of the control device can be assisted in its seating against its valve seat by the pressure of the fuel from the source thereof.

Accordingly, it is an object of this invention to provide an improved fuel control device having one or more of the novel features set forth above or hereinafter shown or described.

Another object of this invention is to provide a fuel control system utilizing such a control device or the like.

Other objects, uses and advantages of this invention are apparent from a reading of this description which proceeds with reference to the accompanying drawings forming a part thereof and wherein.

Figure 1:
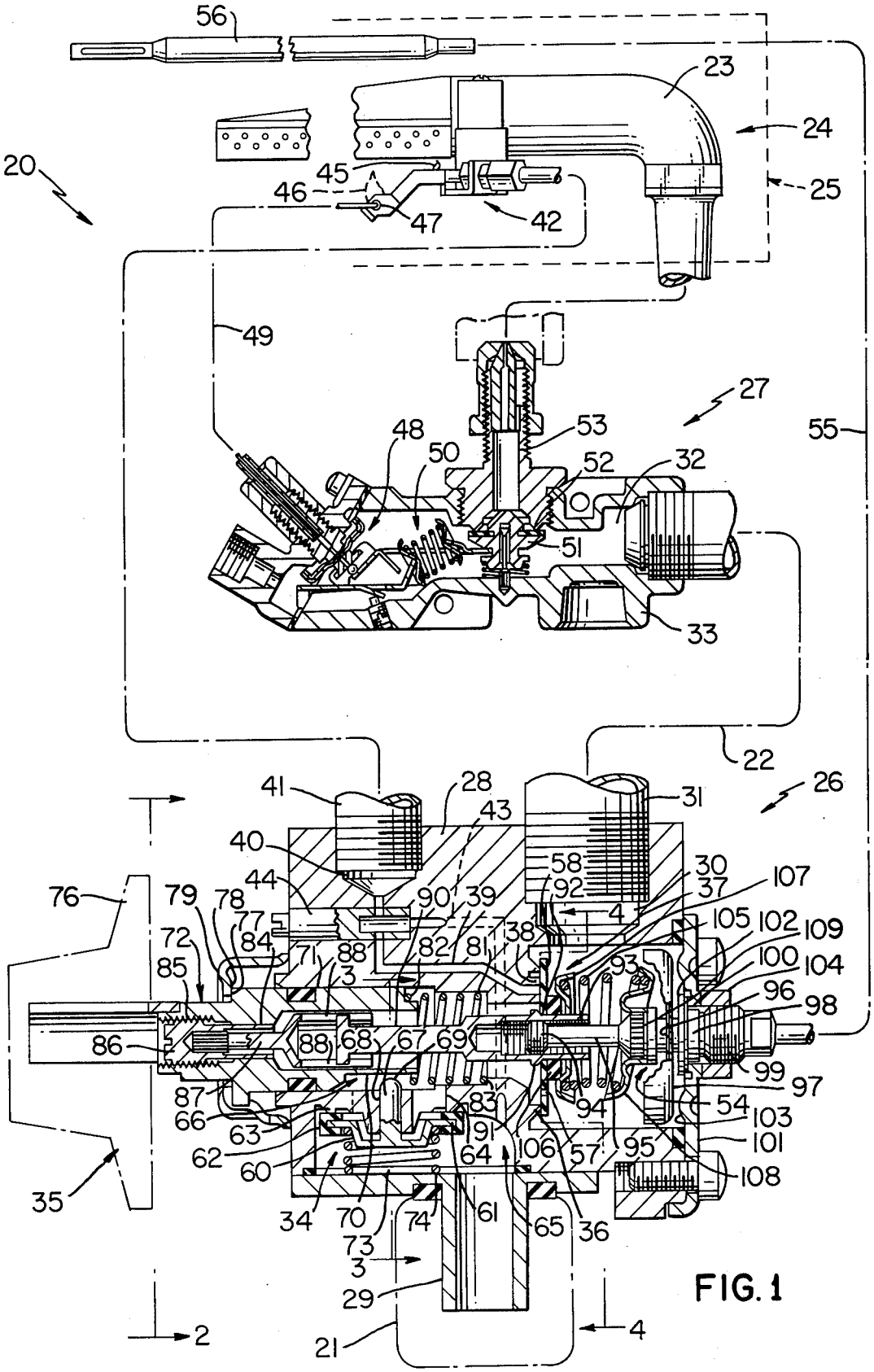
FIG. 1 is a schematic view, partially in cross section, illustrating the improved fuel control device and system of this invention.
Figure 2:
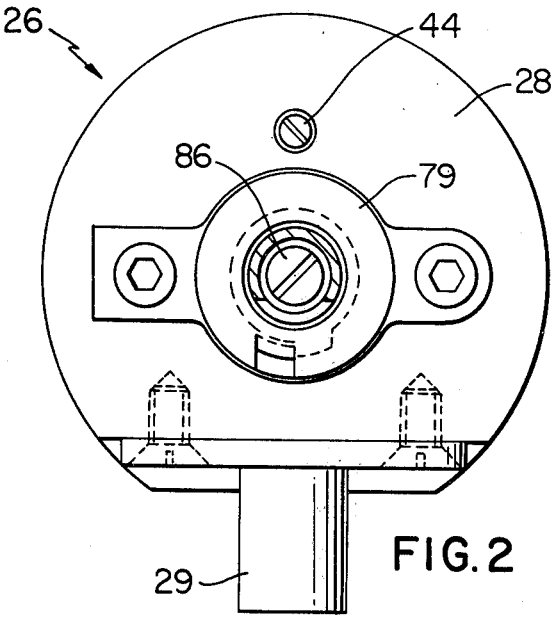
FIG. 2 is a fragmentary, cross-sectional view taken on line 2—2 of FIG. 1.
Figure 3:
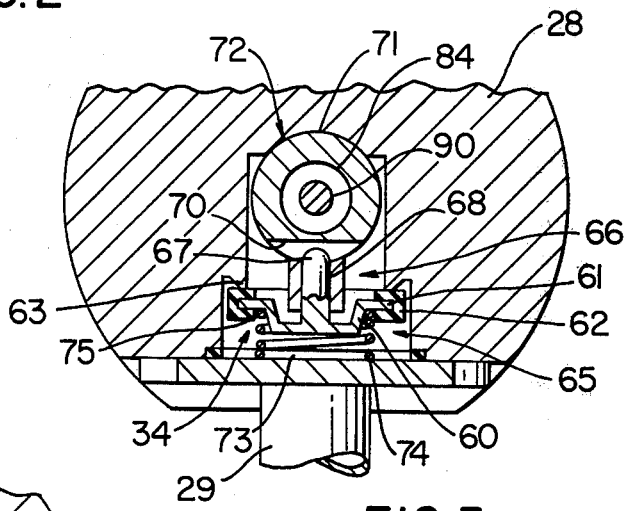
FIG. 3 is a fragmentary, cross-sectional view taken on line 3—3 of FIG. 1.

While the various features of this invention are hereinafter described and illustrated as being particularly adapted to provide a control device for a fuel burning cooking apparatus, it is to be understood that the various features of this invention can be utilized singly or in any combination thereof to provide control devices for other apparatus as desired.

Therefore, this invention is not to be limited to only the embodiments illustrated in the drawings, because the drawings are merely utilized to illustrate some of the wide variety of the uses of this invention.

Referring now to FIG. 1, the improved fuel control system of this invention is generally indicated by the reference numeral 20 and comprises a fuel source manifold 21 being interconnected by passage defining means 22 to a main burner 23 disposed in an oven chamber 24 of a cooking apparatus that is indicated by dash lines and generally indicated by the reference numeral 25, the passage defining means 22 having a pair of control devices disposed therein in series relation and respectively being generally indicated by the reference numerals 26 and 27.

The first fuel control device 26 comprises a housing means 28 having an inlet 29 adapted to be disposed in fluid communication with the fuel supply manifold 21 and an outlet 30 adapted to be interconnected to a conduit means 31 that forms part of the passage defining means 22 and leads to an inlet 32 of a housing means 33 of the second fuel control device 27.

The first fuel control device 26 has a main "on-off" valve means that is generally indicated by the reference numeral 34 in FIG. 1 and is adapted to be directly opened and closed by a selector means 35 of the first fuel control device 26 in a manner hereinafter described. The valve means 34 when moved to an open position will supply fuel from the manifold 21 to a valve seat 36 of the housing 28 that is opened and closed by thermostatically operated valve means that is generally indicated by the reference numeral 37.

The thermostatically operated valve means 37 when opening the valve seat 36, permits the fuel to flow from the opened "on-off" main valve means 34 out through the outlet 30 and thus to the inlet 32 of the second fuel control device 27. The opening of the thermostatic valve means 37 also permits fuel to flow through a second inner valve seat 38 of the fuel control device 26 that leads by a passage means 39 in the housing means 28 to an outlet 40 that is adapted to be coupled by a conduit means 41 to a pilot burner means of the main burner 23, a pilot burner means being generally indicated by the reference numeral 42 and comprising a "dual rate" pilot burner means.

In particular, the pilot burner means 42 is adapted to be continuously fed a flow of fuel at a small rate from the manifold 21 through a passage means 43 of the control device 26 that bypasses the main "on-off" valve means 34 thereof and leads to the outlet 40 through an adjusting key 44 so that the small amount of fuel that is continuously fed to the pilot means 42 can continuously burn at the pilot burner means 42 to provide a small stand-by flame 45 even when the selector means 35 is in an "off" position and the cooking apparatus 25 is not being utilized.

However, when the thermostatically operated valve means 37 opens in a manner hereinafter described, additional fuel is adapted to flow to the outlet 40 of the control device 26 through the opened inner valve seat 38 and interconnecting passage 39 so that the additional fuel flowing to the pilot burner means 42 will create a large heater flame 46 at the pilot burner means 42 that is adapted to be detected by a flame sensor or bulb 47 carried by the pilot burner means 42 and being interconnected to an expandible, contractible member 48 in the housing 33 of the control device 27 by a conduit means or capillary tube 49.

The expandible and contractible element 48 of the control device 27 is interconnected by suitable lever and spring means 50 to a poppet valve member 51 that is normally seated against a valve seat 52 of the housing 33 and thereby blocking the inlet 32 of the housing 33 from an outlet 53 thereof so as to prevent fuel from flowing through the passage defining means 22 to the main burner 23 as the outlet 53 is in fluid communication with the main burner 23.

However, the element 48 expands when the detector 47 is sensing the large heater flame 46 at the pilot burner means 42 and the expansion of the power element 48 causes the lever and spring arrangement 50 to move and hold the poppet valve member 51 from its closed position to a fully open position whereby fuel from the inlet 32 in the control device 27 is now permitted to flow to the outlet 53 thereof and, thus, to the main burner 23 to be ignited by the pilot burner means 42.

Thus, as long as the thermostatically operated valve means 37 of the first fuel control device 26 is in an open condition, not only is fuel supplied from the manifold 21 to the second control device 27, but also fuel is supplied to the pilot burner means 42 through the opened valve seat 38 to continuously produce the large heater flame 46 so that the valve member 51 of the fuel control device 27 will remain in an open condition and pass the fuel on to the main burner 23.

However, the thermostatically operated valve means 37 of the fuel control device 26 has an expandible and contractible power element 54 that controls the opening and closing movements thereof, the power element having its interior interconnected by a conduit means 55 to a temperature sensing bulb 56 disposed in the oven chamber 24 and thereby sensing the output temperature effect of the main burner 23.

Thus, when the temperature in the oven chamber 24 exceeds the temperature setting of the selector means 35 of the fuel control device 26, the thermostatic valve means 37 is closed by the expanded power element 54 to not only block the main flow of fuel from the manifold 21 into the conduit 31, but also to block the flow of fuel into the passage 39 of the fuel control device 26 so that the heater flame 46 will no longer be created at the pilot burner means 42. Since the heater flame 46 no longer appears at the pilot burner means 42, the power element 48 of the control device 27 collapses and through the lever and spring arrangement 50 causes the valve member 51 to close against the valve seat 52.

However, due to a thermal lag created by the delay in the time that it takes the power element 48 of the control device 27 to collapse and cause closing of the valve member 51 from the time the heater flame 46 ceases to exist because the thermostatically operated valve means 37 has closed, there is a likelihood that the fuel remaining in the conduit 31 does not have a sufficient pressure to pass out of the burner means 23 and be burned externally thereof so that a flash back situation could exist when the valve means 37 is closed and the control device 27 has its valve member 51 remaining in its open condition due to the thermal lag in the time it takes the power element 48 to collapse.

Accordingly, a bypass passage or orifice 57 is provided through a valve disc 58 of the thermostatically operated valve means 37 to supply sufficient fuel to the outlet 30 to support combustion at the main burner means 23 whenever the valve disc 58 is fully seated against the valve seat 36 and the fuel control device 27 remains open because of the thermal lag in the closing thereof so that the adverse flash back situation will not exist.

Thus, it can be seen that the fuel control device 26 when set in an "on" position thereof not only opens the main on-off valve means 34 thereof, but also sets the desired output temperature effect of the main burner means 23 so that the main burner 23 can be cycled on and off in the manner previously described to tend to maintain the output temperature effect in the oven chamber 24 at the output temperature setting of the selector 35 of the control device 26.

Since the details and theory of operation of the control device 27 and "dual rate" pilot burner 42 are fully set forth in the U.S. Pat. Nos. to Branson et al, 3,367,572 and the U.S. Pat. to Riehl, 3,405,999, no detailed explanation of the parts and operation of the fuel control device 27 and "dual rate" pilot burner means 42 is deemed necessary as any desired information thereon can be obtained from a reading of the aforementioned patents to Branson et al and Riehl.

However, the details and operation of the fuel control device 26 of this invention will now be described.

The main "on-off" valve means 34 of the control device 26 comprises a poppet valve member 60 that is substantially cup-shaped and has an outer peripheral flange 61 at the open end thereof covered by an annular resilient member 62 adapted to fully seat on an annular valve seat 63 formed in the housing means 28 and surrounding a plurality of openings 64 that lead from a chamber 65 formed in the housing means 28 to a stepped cylindrical chamber 66 formed in the housing means 28, the chamber 65 being interconnected to the inlet 29 while the chamber 66 leads to the annular valve seat 36.

The poppet valve member 60 has a stem 67 passing through a guide opening 68 in the housing 28 in such a manner that a rounded end 69 of the stem 67 is disposed within the chamber 66 and within the path of movement of a cam surface 70 formed on a cylindrical part 71 of a shaft means that is generally indicated by the reference numeral 72 and forming a part of the selector means 35 of the fuel control device 26.

A compression spring 73 is disposed in the chamber 65 and has one end 74 bearing against the housing means 28 and the other end 75 thereof bearing against the poppet valve member 60 to tend to hold the poppet valve member 60 in its closed position against the valve seat 63.

It can also be seen that the fuel pressure being fed from the source 21 into the chamber 65 of the housing means 28 also acts against the valve member 60 in a manner to hold the valve member 60 in its closed position against the valve seat 63.

Thus, when the selector means 35 is in its "off" position, the fuel pressure from the source 21, as well as the compression spring 73, acts to hold the valve member 60 in its closed position against the valve seat 63 so that even though the usual pressure of the fuel in the manifold 21 should increase through a malfunction in a pressure regulator or the like upstream from the manifold 21, the valve member 60 will not be blown off the valve seat 63 but will be further urged against the valve seat 63 so as to prevent such fuel from entering into the control system 20 and creating an adverse situation as previously described.

The shaft means 72 has the shaft part 71 thereof interconnected to a suitable control knob 76 of the selector means 35 and has a shoulder 77 thereof normally urged toward and against the inside surface 78 of a casing member 79 secured to the housing means 28 in alignment with the cylindrical bore or chamber 66 whereby the shaft part 71 closes the left-hand side of the chamber 66. If desired, suitable sealing means 80 can be provided on the shaft part 71 to fluid seal the left-hand part of the chamber 66 as illustrated in FIG. 1. The shoulder 77 of the shaft part 71 is urged against the surface 78 of the casing 79 by a compression spring 81 disposed within the right-hand part of the chamber 66 and having one end 82 bearing against the shaft part 71 and the other end 83 thereof bearing against the housing means 28.

The shaft part 71 has a stepped bore 84 passing therethrough with the bore 84 having its left-hand part 85 internally threaded to receive a threaded adjusting member 86 that carries a member 87 provided with a pair of slots 88 in the right-hand end thereof and which respectively receive opposed outwardly directed tangs on the left-hand end of a shaft part 90 that has a conical outwardly extending abutment 91 thereon. The shaft part 90 is adapted to have its right-hand end in FIG. 1 extend through an opening 92 in the valve disc 58 of the thermostatically operated valve means 37 with the outwardly directed conical abutment 91 being larger than the opening 92 in the valve disc 58 to carry the valve disc 58 therewith in a manner hereinafter described.

The right-hand end of the shaft part 90 is interrupted by a threaded bore 93 which receives a threaded end 94 of a stem member 95 that is carried on a cup-shaped movable wall 96 of the power element 54 which has another cup-shaped wall 97 fixed to a pin means 98 to be carried thereby.

The pin means 98 has a threaded portion 99 adapted to pass through an opening 100 in an end plate 101 of the housing means 28 while a disc-like part 102 of the pin 98 is adapted to abut against the inside surface 103 of the plate 101 in the manner illustrated in FIG. 1. With the plate 102 of the pin 98 abutting against the end plate 101, a lock nut 104 can be threaded on the threaded part 99 of the pin 98 to hold the power element 54 in the position illustrated in FIG. 1, the pin 98 fluidly interconnecting the capillary tube 55 to the spacing between the two cup-shaped members or walls 96 and 97 that have the outer peripheries of the open ends thereof sealed together in a conventional manner.

While the valve disc 58 is loosely disposed on the shaft part 90, the same is either urged toward or against the valve seat 36 or against the conical abutment 91 of the shaft part 90 by a compression spring 105.

In particular, a flexible washer-like member 106 is telescoped onto the shaft member 90 and is disposed against the right side of the disc 58 in FIG. 1. Thereafter, spring retainer 107 is telescoped onto the shaft part 90 against the washer-like member 106.

A spring retainer 108 is disposed on an enlarged knurled part 109 of the shaft 95 so as to fix the same from rotation thereon, the spring retainer 108 being angled relative to the longitudinal and rotational axis of the shaft means 72 so as to cause the compression spring 105 disposed between the spring retainers 107 and 108 to cause tilting of the valve member 58 during its initial opening movement from the valve seat 36 at the same angle relative thereto each time the valve disc 58 initially opens the valve seat 36 as will be apparent hereinafter as well as each time the valve disc 58 closes the valve seat 36.

Figure 4:
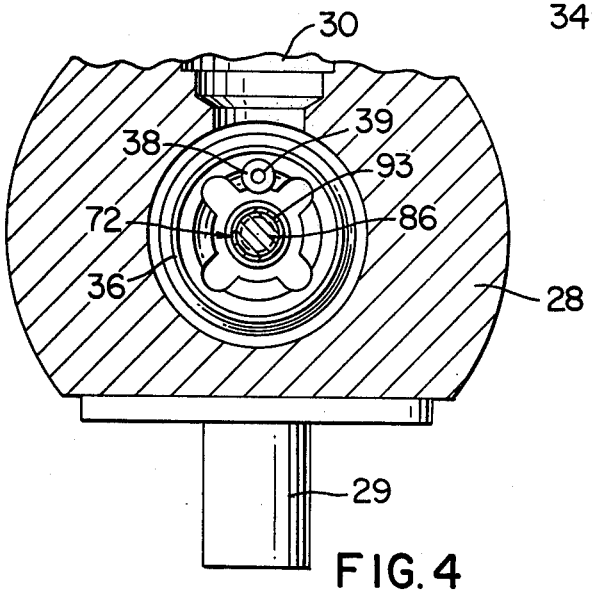
FIG. 4 is a fragmentary, cross-sectional view taken on line 4—4 of FIG. 1.

Rotation of the shaft means 72 by the knob 76 to the "off" position illustrated in FIG. 1 causes the shaft part 71 and part 87 interconnected thereto to rotate in unison and thereby rotate the shaft part 90 and cause the same to rotate relative to the threaded end 94 of the pin 95 and thereby axially move to the left relative thereto by unthreading on the end 94 whereby the abutment 91 of the part 90 moves to the left in FIG. 1 a sufficient distance that even though the power element 54 is in its completely collapsed condition, the spring 105 will maintain the valve disc 58 fully seated against the valve seat 36 so as to close not only the valve seat 36, but also close the small valve seat 38 that is disposed inboard of the main valve seat 36 in the manner illustrated in FIG. 4.

Figure 5:
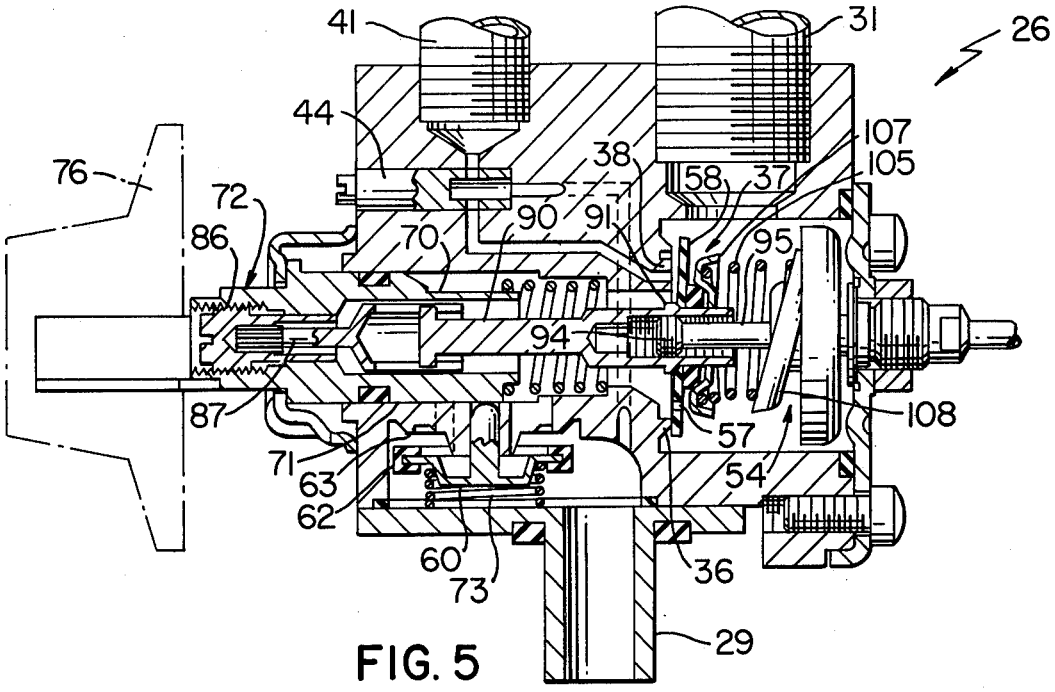
FIG. 5 is a fragmentary view similar to FIG. 1 and illustrates the control device of this invention as the same has its thermostatically operated valve means initially opening.

However, when the shaft means 72 is rotated by the knob 76 to an "on" position thereof, such rotation of the shaft part 71 not only causes the cam means 70 thereof to operate against the rounded end 69 of the poppet valve member 60 to move the same to a fully open condition thereof as illustrated in FIG. 5, but also such rotation of the shaft part 71 causes the member 90 to thread onto the member 94 and be moved to the right in FIG. 1 to abut and move the valve member 58 therewith so that the valve seat 36 will be fully opened as long as the temperature in the oven chamber 24 is not at the temperature setting of the selector means 35.

However, when the power element 54 expands as the temperature in the oven chamber 24 increases, the power element 54 will expand in such a manner that the same will move the valve disc 58 fully against the valve seat 36 when the output temperature effect in the oven chamber 24 is substantially at or slightly above the set temperature setting of the selector means 35.

From the above, it can be seen that the control device 26 can be formed in a relatively simple manner to provide a positively closed main "on-off" poppet valve member and a thermostatically controlled valve means 37 to be utilized in the fuel control system 20 in a manner now to be described.

When the operator desires to utilize the cooking apparatus 25, the knob 76 of the selector means 35 is moved from the "off" position thereof to the desired temperature setting position thereof. As the shaft means 72 is being rotated by the knob 76, the cam surface 70 of the shaft part 71 acts against the stem 67 of the poppet valve member 60 to move the same to an open position as illustrated in FIG. 5 and hold the same in such open position regardless of where the selector means 35 is subsequently set in any of its oven "on" positions.

If desired, the poppet valve member 60 and the shaft part 71 can be formed of steel to reduce wear therebetween for long life, such cam arrangement reducing or eliminating the need for lubrication in the field as is required by prior known main "on-off" valve arrangements.

Also, such opening of the poppet valve means 34 causes an initial full flow of fuel through the valve seat 63 as the valve member 60 tends to open with a snap movement once the same is initially cracked open by the cam 70 of the shaft means 72 and because the poppet valve means 34 is disposed in the inlet without having a restricted or torsions flow path for the fuel to pass through before the same reaches the thermostatically operated valve means 37.

As previously stated, such rotation of the shaft means 72 causes the member 90 to be more threaded on the threaded end 94 of the pin 95 to a certain position so that the valve disc 58 is held away from the valve seat 36 by the abutment means 91 in opposition to force of the spring 105 and thereby permits fuel to flow from the fuel source manifold 21 through the open poppet valve means 37 to the outlet 30 and, thus, to the safety valve control device 27. Fuel also flows through the opened valve seat 38 to the pilot burner means 42 to create the heater flame 46. When the heater flame 46 is created, the same is detected by the detector 47 and the poppet valve member 51 of the control device 27 is moved to its open position whereby fuel is now adapted to flow to the main burner 23 and be ignited by the pilot burner means 42. The thus operating burner means 23 begins to heat up the oven chamber 24 to the temperature selected by the selector means 35.

When the temperature in the oven chamber 24 reaches the temperature setting of the selector means 35 or is slightly above the same, the power element 54 has expanded in such a manner that the same has caused the valve disc 58 to fully seat against the valve seat 36 and thereby close off the flow of fuel not only to the outlet 30, but also to the valve seat 38 that leads to the pilot burner means 42. In this manner, the heater flame 46 ceases to exist and the control device 27 will subsequently close thereby terminating any flow of fuel to the main burner means 23. As previously stated, during the delay in time from the time the valve disc 58 is fully seated against the valve seat 36 and the valve member 51 of the control device 27 has fully seated against the valve seat 52, the opening 57 through the valve disc 58 supplies sufficient fuel to the main burner means 23 to support combustion at the main burner means 23 so that no adverse flash back situation can exist.

The valve disc 58 remains seated against the valve seat 36 until the output temperature effect in the oven cavity 24 falls below the selected temperature setting thereof whereby the power element 54 is collapsing in such a manner that the same is pulling the shaft part 90 to the right in FIGS. 1 and 5 in such a manner that the conical abutment 91 thereof engages against the valve disc 58 to pull the same to the right therewith. However, because the compression spring 105 has one side held at an angle by the angled spring retainer 108 whereby the spring 105 has its most compressed portion disposed 180° from the valve seat 36 with a tilting action as illustrated in FIG. 5 so that each time the valve disc 58 is opened relative to the valve seat 36, the same will open with the same angle of tilt so that the flow of fuel that is adapted to pass into the thus open valve seat 38 to cause the heater flame 46 will always occur when the valve disc 58 has been initially cracked open relative to the valve seat 36 at exactly the same position in its opening movement so that proper calibration of the control device 26 can be maintained.

For example, should the valve member 58 be permitted to tilt at any random angle relative to the valve seat 38 during the initial opening of the valve member 58 relative to the valve seat 36, it will require the collapsing of the power element 54 to be at a greater degree of collapse thereof, if the valve member 58 should tilt 180° from the tilt angle illustrated in FIG. 5, before the valve member 58 will permit sufficient fuel to flow into the valve seat 38 to produce the heater flame 46 when the valve member 58 is permitted to tilt 180° from the valve seat 38 in the manner illustrated in FIG. 5.

Thus, for each temperature setting of the selector means 35, a deviation in the maintained temperature in the oven 24 would take place if the valve member 58 were not caused to open with a tilt relative to the valve seat 36 at exactly the same angle each time the same is cycled by the power element 54 to an open position thereof.

Accordingly, while the spring retainer 108 is illustrated as providing the greatest compression to the spring 105 at a position 180° from the valve seat 38, it is to be understood that the spring retainer 108 could be utilized to provide for the disc 58 to tilt 90° relative to the valve seat 38 or even at the valve seat 38 if desired, the important feature being that the tilt of the valve member 58 in its opening and closing movement relative to the valve seat 36 and, thus, relative to the valve seat 38 always to be the same for that particular control device 26 so that the particular control device can be properly calibrated in a manner now to be described.

In the embodiment of the control device 26, it can be seen that by adjusting the threaded relation of the adjusting member 86 in the shaft part 71, the position of the abutment means 91 relative to the power element 54 when the bulb 56 is sensing a certain temperature can be set so that the thermostatically operated valve means 37 will operate to produce the desired output temperature effect in the oven 24 that is selected by the selector means 35 by having the valve disc 58 open when the bulb 56 is sensing a temperature just below the selected temperature of the selector means 35 of the control device 26.

Figure 6:
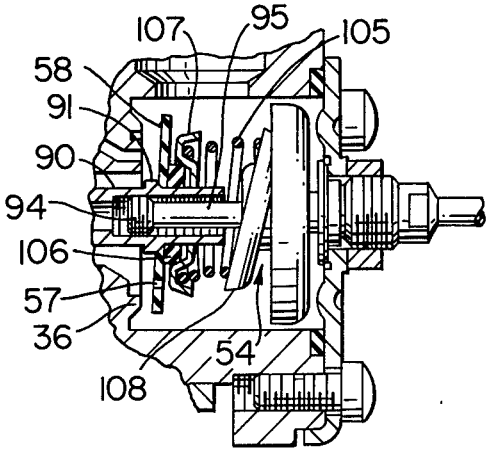
FIG. 6 is a partial view similar to FIG. 5 and illustrates the thermostatically operated valve means of the control device of this invention in a fully open position thereof.
Figure 7:
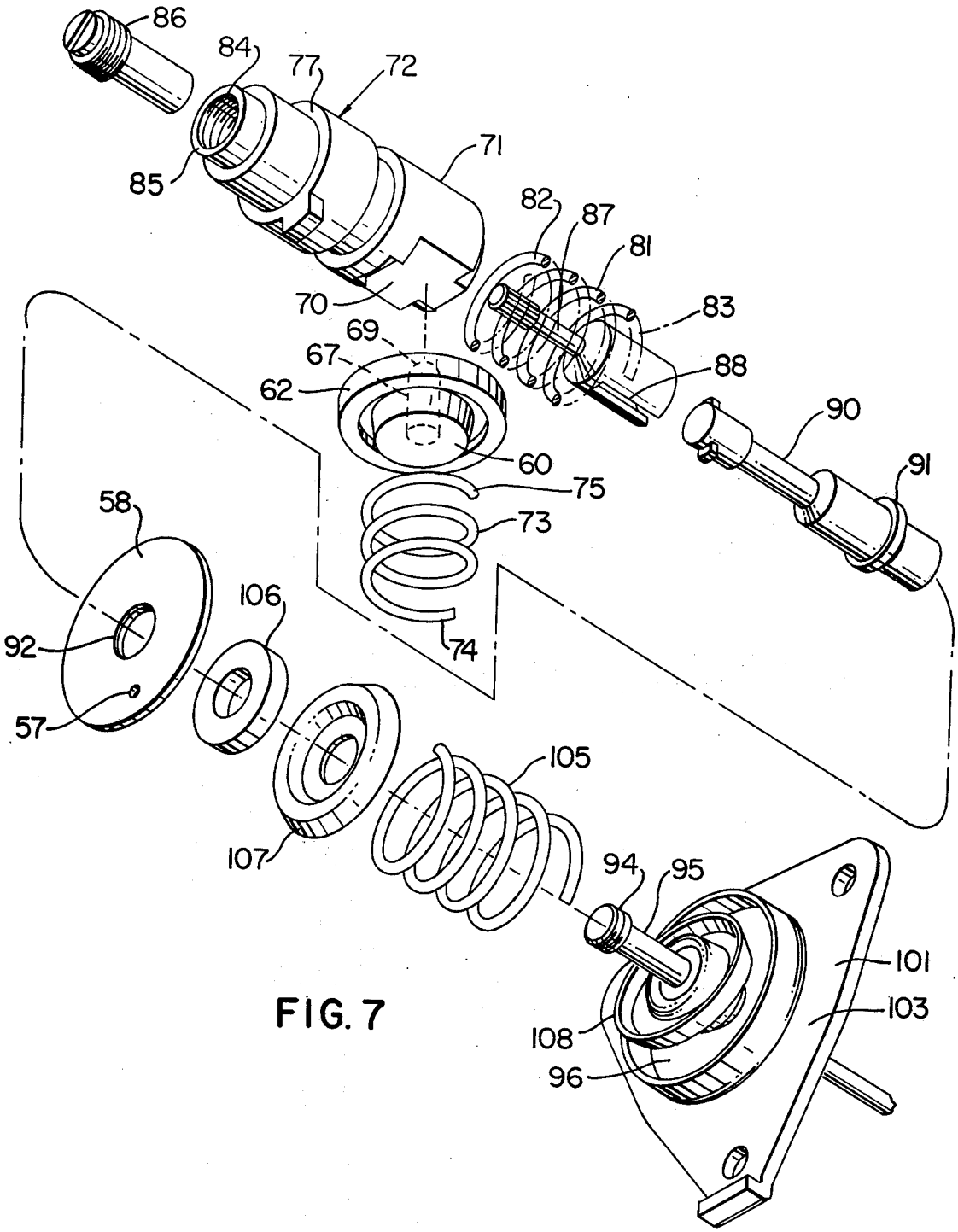
FIG. 7 is an exploded perspective view of certain parts of the fuel control device illustrated in FIG. 1.

Of course, the valve disc 58 will continue to move away from the valve seat 36 to the position illustrated in FIG. 6 should the output temperature effect in the oven 24 not increase to the setting of the knob 76 so that an increased flow of fuel will be provided to the burner means 23 through the thermostatically operated valve means 37.

Thus, the valve disc 58 can thermostatically control the flow of fuel from a minimum amount thereof that will support combustion at the burner means 23 to a full flow of fuel thereof as illustrated in FIG. 6.

The control device 26 is so constructed and arranged that when the selector means 35 is set for a broiling operation, the member 90 has been threaded on the threaded part 94 of the pin 95 such a distance that the power element 54 will not expand sufficiently to cause the valve disc 58 to fully seat against the valve seat 36 during the broiling operation so that a continuous flame broiling operation can be provided by the burner means 23.

When it is desired to turn off the control system 20, the operator rotates the control knob 76 to the "off" position of the selector means 35 whereby the flat portion of the cam surface 70 of the shaft part 71 is now adjacent the end 69 of the poppet valve member 60 so that the same can be fully seated against the valve seat 63 not only by the force of the compression spring 73, but also by the force of the fuel pressure in the inlet 29 of the control device 26. Also, such rotation of the shaft part 71 to the "off" position causes the member 90 to be unthreaded from the threaded end 94 of the pin 95 a distance sufficient that the abutment means 91 thereof will not cause the valve disc 58 to open from the valve seat 36 even though the power element 54 would be in a fully collapsed condition thereof by the bulb 56 sensing very low temperatures, such as room temperature.

Because the poppet valve means 34 has a relatively large flexible member 62 engaging the valve seat 63 when the poppet valve member 60 is moved to its closed position, any dirt particles and the like that might be on the valve seat 63 are fully enveloped by the resilient member 62 so that full closure of the seat 63 can take place and no fuel leakage through the valve seat 63 will take place because of such enveloped dirt particles.

Therefore, it can be seen that this invention not only provides an improved fuel control device 26 that has a main "on-off" poppet valve member that is positively seated by the fuel pressure when in an "off" condition thereof, but also this invention provides a fuel control system wherein two poppet valve members 60 and 51 are disposed in series relation between the source of fuel 21 and the main burner 23 and both are positively seated by fuel pressure when the same are in the "off" positions in a manner to tend to prevent any adverse high fuel pressures from escaping out of the system 20 should a malfunction occur in a pressure regulator anywhere in the fuel supply system.

Figure 18:
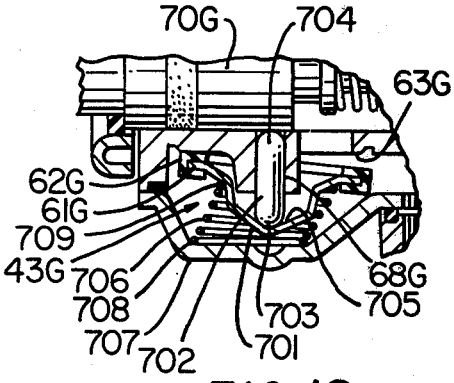
FIG. 18 is a fragmentary view of the poppet valve means of the control device of FIG. 8 with the poppet valve means in an open position thereof.

Another control device of this invention is generally indicated by the reference numeral 26G and is best illustrated in FIG. 18, the parts of the control device 26G that are similar to parts of the previously described control devices will be indicated by like reference numerals followed by the reference letter "G."

As illustrated in FIG. 18, the control device 26G has a two-piece main "on-off" poppet valve means 34G, a modified thermostatically operated valve means 37G and a unique expandible and contractible power element assembly that is generally indicated by reference numeral 700, the control device 26G, however, operating substantially in the same manner as the control device 26 of FIG. 1 to operate a control system similar to the control system 20 previously described.

The poppet valve means 34G comprises a hat-shaped poppet valve member 701 having the previously described resilient member 62G snap fitted around the outer peripheral edge 61G of the poppet valve member 701 for sealing closed against the valve seat 63G that is utilized to interconnect the inlet 29G to the chamber 66G that leads to the thermostatically controlled valve seat 36G.

A separate valve stem member 702 is disposed in the bore 68G formed in the housing means 28G of the control device 26G so as to be axially movable and guided by the bore 68G, the valve stem member 702 having opposed hemispherical ends 703 and 704 for respectively engaging against the inside appropriately shaped surface 705 of the hat-shaped poppet valve member 701 and being disposed adjacent the cam means 70G of the selector means 76G.

Figure 8:
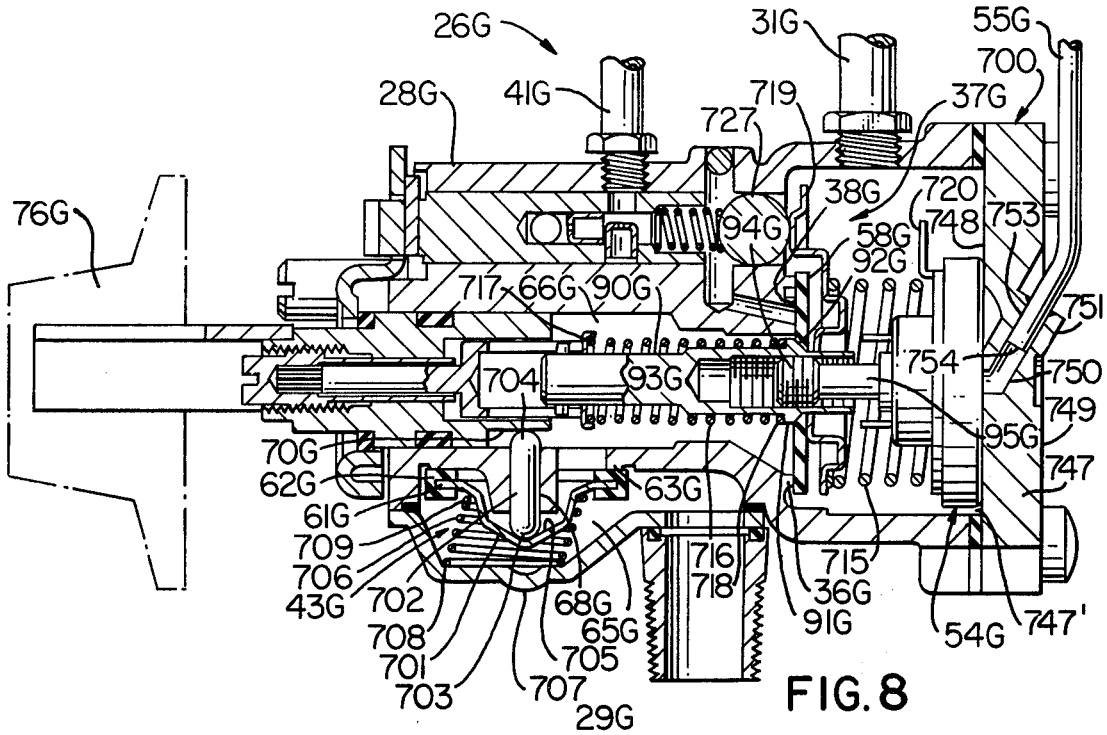
FIG. 8 is a view similar to FIG. 1 and illustrates in cross section another fuel control device of this invention.

Thus, when the selector knob 76G is turned to an "on" position thereof the rotation of the selector means 76G causes the cam 70G to act against the valve stem 702 to move the valve stem 702 downwardly in FIG. 8 and thereby move the poppet valve member 701 away from the valve seat 63G in the manner illustrated in FIG. 18 in opposition to the force of a compression spring 706 disposed between the poppet valve member 701 and a casing part 707 that cooperates with the housing means 28G to define the chamber 65G that leads from the inlet 29G to the valve seat 63G. Conversely when the selector knob 76G is turned to the "off" position as illustrated in FIG. 18, the cam means 70G permits the valve stem 702 to move upwardly in FIG. 8 under the force of the compression spring 706 so that the poppet valve member 701 can again close the valve seat 63G as illustrated in FIG. 8 for the purpose previously described.

However, it was found according to the teachings of this invention that should the poppet valve member 701, when being moved to the open position by the selector knob 76G being moved to the open position in the manner previously described, tilt relative to the valve seat 63G so that the tilt opening of the poppet valve member 701 relative to the valve seat 63G face away from the inlet part of the chamber 65G, insufficient fuel might be supplied through the valve seat 63G for proper operation of the system 20 as previously described, and, particularly, when the housing 28G surrounds the left side of the valve seat 63G to restrict flow at that side as illustrated in FIG. 8.

Therefore, one of the features of this invention is to provide means for always insuring that the poppet valve member 701 when moving away from the valve seat 63G will tilt at the same angle so that the largest part of the opening of the poppet valve member 701 relative to the valve seat 63G will face toward the inlet part of the chamber 65G in the manner illustrated in FIG. 18.

The means of this invention for accomplishing the aforementioned feature is to offset the end 708 of the compression spring 706 from the end 709 thereof that engages the poppet valve member 701 in such a manner that the axis of the spring 706 is disposed substantially angularly relative to the axis of the valve seat 63G so as to cause the poppet valve member 701 to always tilt at the angle illustrated in FIG. 18 when the valve member 701 is moved to an open position by the cam means 70G.

In order to hold the end 708 of the spring 706 in the desired offset relation illustrated in FIG. 8, the casing part 707 is provided with a spring receiving recess 710 as illustrated in FIG. 31 which is offset relative to the center line of movement of the valve stem 702 as illustrated in FIG. 8 whereby the end 708 of the compression spring 706 is held in the desired offset relationship for causing the poppet valve member 701 to always tilt relative to the valve seat 63G at the angle illustrated in FIG. 18 so that the greatest amount of opening of the poppet valve member 701 will be facing toward the inlet side of the chamber 65G so that sufficient fuel will always tend to flow to the valve seat 63G when the poppet valve member 701 is opened.

Of course, it is to be understood that other means could be provided for holding the end 708 of the spring 706 in the desired offset relation.

Figure 20:
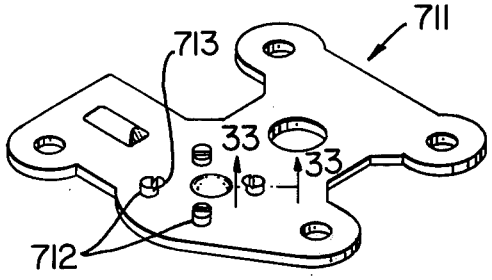
FIG. 20 is a view similar to FIG. 19 and illustrates another embodiment of the casing member of this invention.
Figure 21:
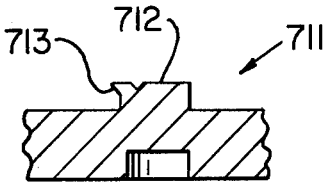
FIG. 21 is an enlarged, fragmentary, cross-sectional view taken on line 21—21 of FIG. 20.

For example, another casing plate of this invention is generally indicated by the reference numeral 711 in FIGS. 20 and 21 and could be utilized with an appropriately shaped housing means 28G to close off a chamber 65G thereof that would contain the poppet valve means 34G previously described, the plate 711 having a plurality of outwardly directed tab means 712 formed in a circular array to have parts 713 thereof staked over the end 708 of the spring 706 to hold the spring end 708 in a desired offset relation relative to the other end 709 thereof which is substantially concentrically disposed about the valve stem 702.

Thus, the chamber 65G of the control device 26G can be made relatively small with the assurance that sufficient fuel will always flow through the valve seat 63G when the poppet valve member 701 is moved to an open position thereof.

The thermostatically operated valve means 37G of the control device 26G includes the axially movable shaft 90G that is splined by the spline pin 714 to the selector means 76G to rotate in unison therewith while being axially movable relative thereto, the shaft 90G having the conical abutment 91G for abutting against the disc 58G that is disposed on the shaft 90G through an opening 92G therein.

The valve member 58G controls the valve seat 36G which is adapted to feed fuel to the outlet 31G when the valve seat 36G is opened. Similarly, the valve disc 58G controls the inner valve seat 38G for supplying the pilot burner means through the outlet means 41G in the manner previously described.

However, it was found according to the teachings of this invention that with the control device 26 of FIG. 1, should the valve member 58 be closed against the valve seat 36 and the power element 54 is still expanding in a direction to close the valve member 58 against the valve seat 36, such overrun expansion of the power element 54 will move the shaft 90 further to the left in FIG. 1 whereby the conical abutment 91 of the shaft 90 is moved away from the opening 92 in the valve disc 58 whereby leakage might occur through such opening 92 if it were not for the sealing member 106 urged against the valve member 58 by the tilt acting spring 105 previously described.

However, it is found according to the teachings of this invention that the sealing member 106 tends to restrict or restrain the desired tilting action of the valve disc 58 relative to the valve seat 36 during the opening of the valve seat 36.

Therefore, such sealing member 106 of the control device 26 is eliminated from the control device 26G of FIG. 8 and the shaft 90G is so constructed and arranged the the same will never move further to the left in FIG. 8 after the valve member 58G is moved to its fully closed position against the valve seat 36G as the overrun of a further expanding power element 54G of the control device 26G is taken up by a compression spring 715 in a manner hereinafter described.

Thus, another compression spring 716 is disposed about the shaft 90G with one end 717 being fixed from movement by being disposed against the selector means 76G and with the other end 718 bearing against the abutment 91G of the shaft 90G to always tend to maintain the abutment 91G of the shaft 90G in firm engagement with the valve disc 58G at the opening 92G thereof so as to fluid seal the opening 92G at all times even during an overrun of the power element 54G as will be apparent hereinafter.

The compression spring 715 is disposed between two spring retainer members 719 and 720 whereby the opposed ends 721 and 722 of the spring 715 respectively engage the retainers 719 and 720.

Figure 9:
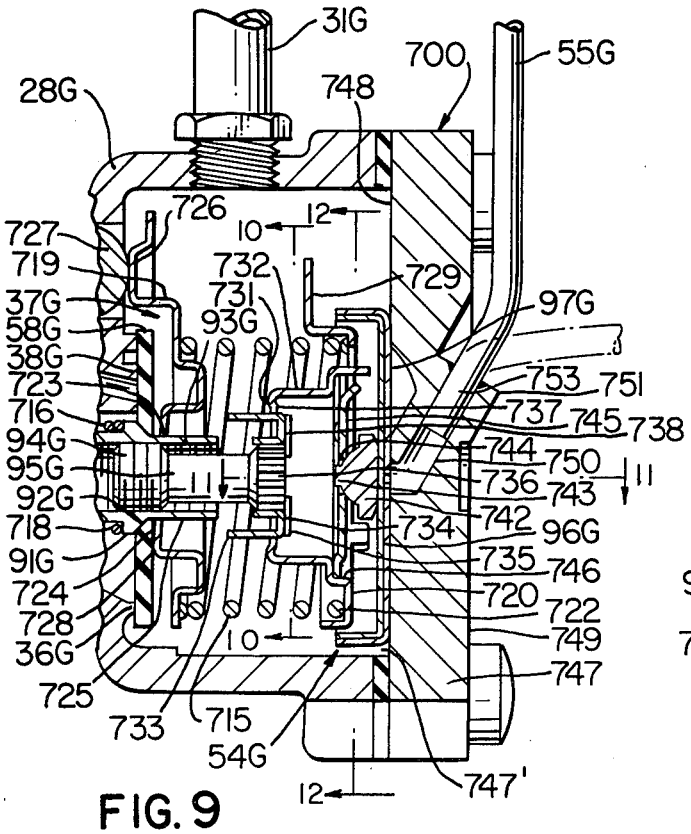
FIG. 9 is an enlarged, fragmentary view of the right-hand end of the control device of FIG. 8 with other parts thereof also shown in cross section.
Figure 10:
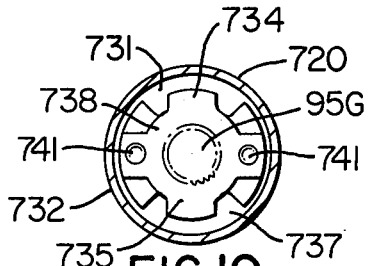
FIG. 10 is a fragmentary, cross-sectional view taken on line 10—10 of FIG. 9.
Figure 11:
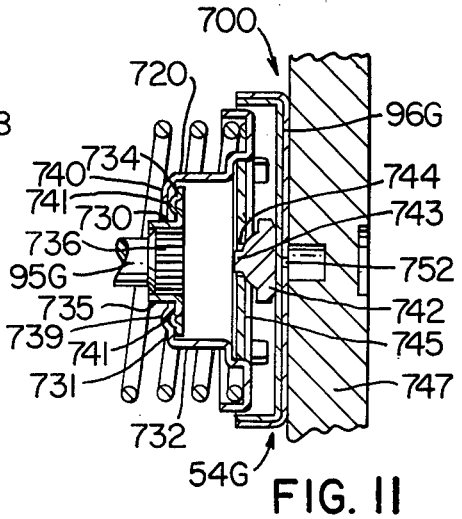
FIG. 11 is a fragmentary, cross-sectional view taken on line 11—11 of FIG. 9.
Figure 13:
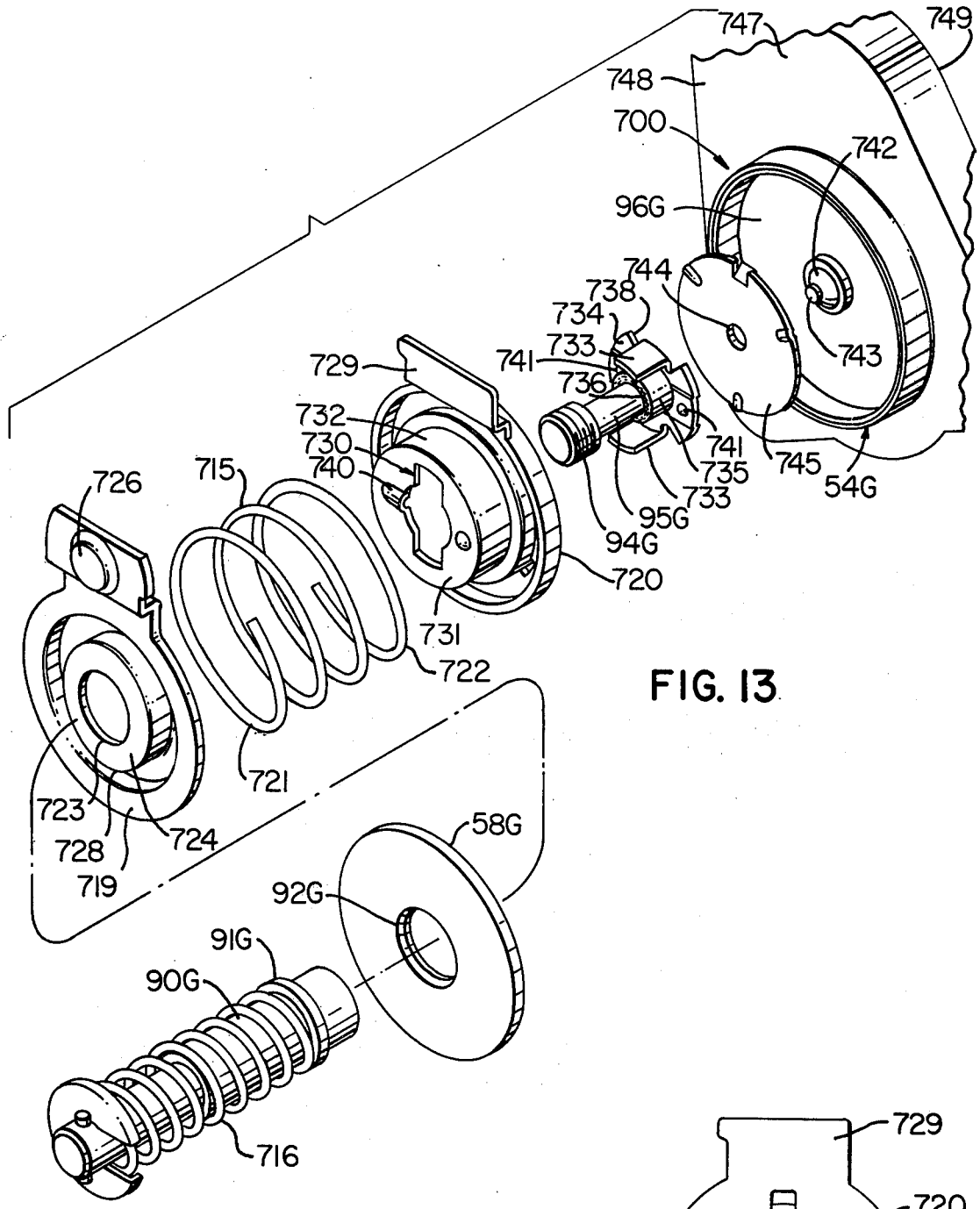
FIG. 13 is an exploded perspective view of the various parts of the control device of FIG. 8 for operating the thermostatically operated valve means thereof.
Figure 12:
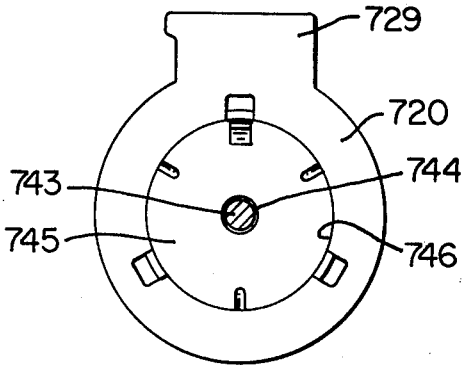
FIG. 12 is a fragmentary, cross-sectional view taken on line 12—12 of FIG. 9.

The spring retainer 719 has an opening 723 formed through an angularly disposed central wall 724 thereof so as to receive a forward end 725 of the shaft 90G therethrough as illustrated in FIG. 9 and thereby be guided in its movement by the shaft 90G.

The spring retainer 719 has an outwardly directed flange 726 which is adapted to engage against a ball seal member 727 of the housing means 28G in the manner illustrated in FIG. 9 under the force of the compression spring 715 when the valve disc 58G is fully seated against the valve seat 36G whereby the lower part or end 728 of the angled wall 724 of the spring retainer 719 is engaging against the valve member 58G intermediate the lower part of the valve seat 36G and the abutment 91G of the shaft 90G to hold the valve member 58G in its closed position.

Figure 16:
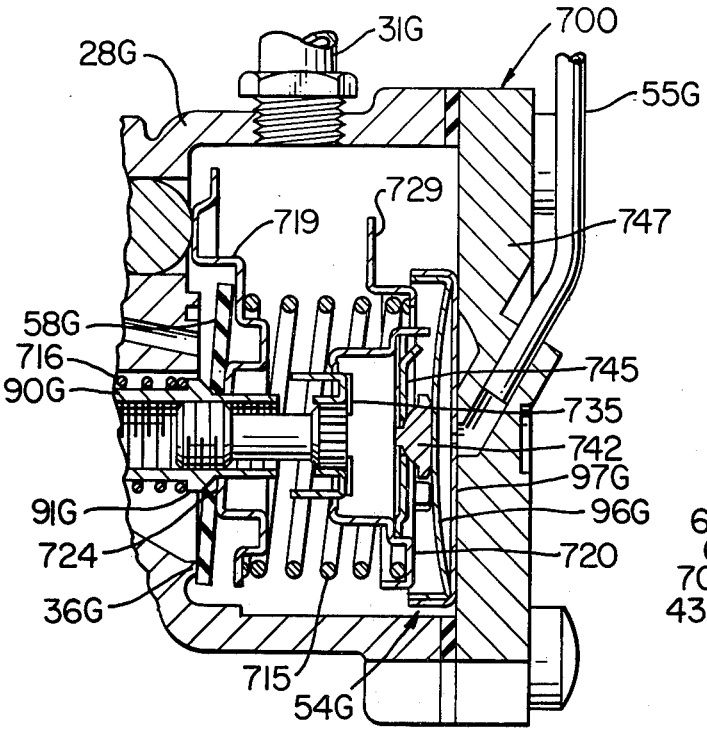
FIG. 16 is a view similar to FIG. 14 and illustrates the initial opening of the thermostatically operated valve means of the control device of FIG. 8.

Thus, as the valve member 58G is initially moved to the right by the abutment 91G and shaft 90G being permitted to move to the right under the force of the compression spring 716 either through a collapsing of the power element 54G as illustrated in FIG. 16 or by the selector means 76G being turned from its "off" position of FIG. 8 to an "on" position thereof, the valve member 58G pivots or tilts on the lower part of the valve seat 36G and tilts on the abutment 91G until the upper part of the valve disc 58G abuts against the upper part of the angled surface 724 of the spring retainer 719 in the manner illustrated in FIG. 16. Thereafter, the spring retainer 719 moves to the right with the shaft 90G to further cause the valve member 58G to open the valve seat 36G.

Figure 17:
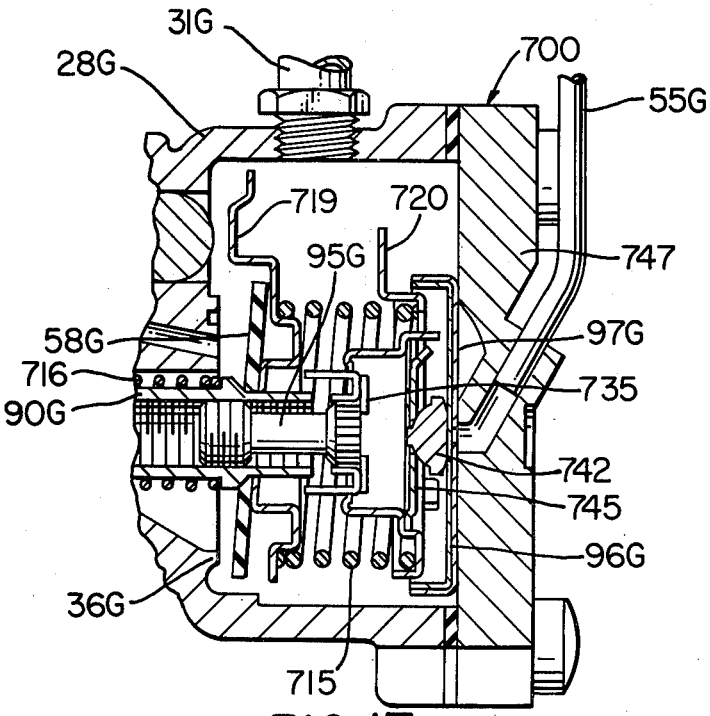
FIG. 17 is a view similar to FIG. 16 and illustrates the thermostatically operated valve means in a fully opened position thereof.

Accordingly, it can be seen that the spring 715 in combination with the spring retainer 719 will always cause the valve member 58G to tilt relative to the valve seat 36G at the same angle illustrated in FIGS. 16 and 17 during the opening and closing of the valve member 58G relative to the valve seat 36G for the same reasons previously set forth in connection with the tilting of the valve member 58 relative to the valve seat 36 for the control device 26.

The other spring retainer 720 likewise has an outwardly directed flange 729 which is similar to the flange 726 of the spring retainer 719, the flange 726 and 729 being captured in the housing means 28G in such a manner the retainers 719 and 720 cannot rotate relative thereto but are permitted to move axially relative thereto during the operation of the thermostatically operated valve means 37G.

The spring retainer 720 has a cutout 730 formed through a central end wall 731 of a cup-shaped portion 732 thereof to receive therethrough a pair of inwardly directed tangs or legs 733 formed on a plate portion 734 of a member 735 fastened on an end 736 of the adjusting pin 95G that has its threaded end 94G threadedly received in the threaded bore 93G of the right hand portion 725 of the shaft 90G. However, the adjusting member 95G is not directly interconnected to the movable wall 96G of the power element 54G as in the embodiment of FIG. 1.

The force of the compression spring 715 causes an inside surface 737 of the spring retainer 720 to be urged against the surface 738 of the disc portion 734 of the adjusting member of the member 735 so as to be in contact therewith, the tangs 733 of the member 735 protruding through the cutout 730 of the end wall 731 of the spring retainer 720 so as to prevent rotation of the member 95G relative to the housing 28G so that the shaft 90G can be threaded onto and off of the pin 95G through the rotation of the selector knob 96G in the manner previously described for the control device 26 for temperature setting purposes.

In order to prevent backlash or slight rotation movement between the members 95G and spring retainer 20 during such rotational movement of the selector means 76G through loose tolerances of the legs 733 and the cutout 730, the inside surface 737 of the spring retainer 720 has a dimple 739 on one side of the cutout 730 and an elongated dimple recess 740 on the other side of the cutout 730 which are adapted to respectively receive outwardly directed dimples 741 formed on the surface 738 of the member 735 so as to be directly interconnected together by the dimple means 741, 739, and 740 in the manner illustrated in FIG. 8.

Figure 15:
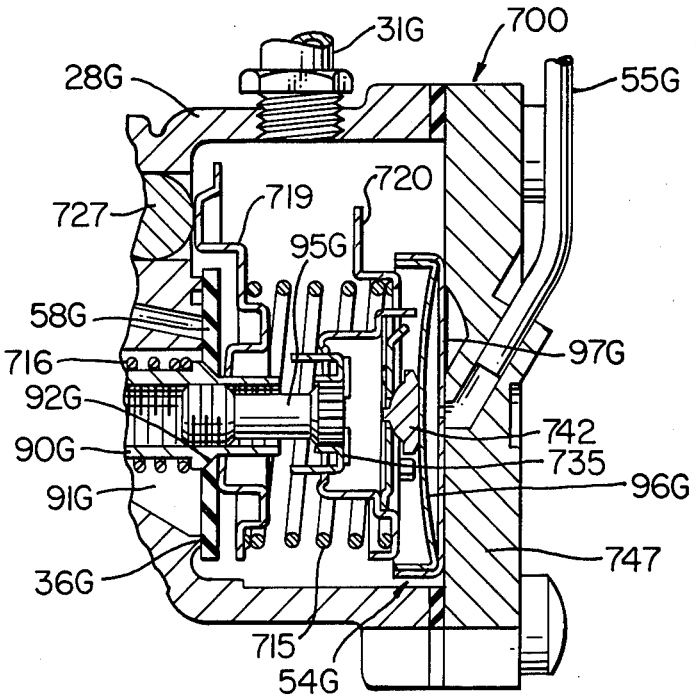
FIG. 15 is a view similar to FIG. 14 and illustrates an overrun condition of the thermostatically operated valve means.

However, should the valve member 58G be fully seated against the valve seat 36G in the manner illustrated in FIG. 9 and the power element 54G should further expand to the left, such movement is permitted by the spring 715 being further compressed by the retainer 720 being moved toward the retainer 719 as the retainer 720 can move to the left relative to the mannber 735 by having the cutout 730 slide down the tangs 733 in the manner illustrated in FIG. 15 to take up such overrun movement of the power element 54G without having the abutment 91G of the shaft 90G moved away from the opening 92G of the valve disc 58G as previously described so that full sealing exists at the opening 92G of the valve disc 58G when the valve disc 58G is seated at the valve seat 36G during an overrun of the power element 54G.

Further, it can be seen that the spring 715 operatively connects the movable wall 96G of the power element 54G to the valve member 58G rather than being interconnected thereto through the member 95G as in the control device 26 previously described.

Figure 19:
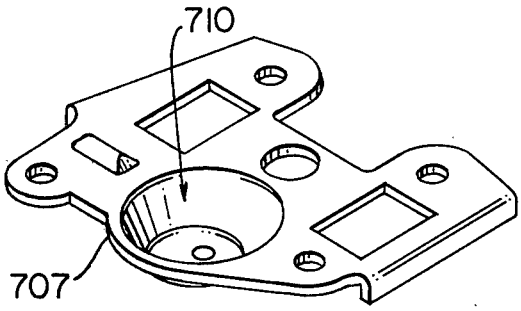
FIG. 19 is a perspective view of the casing member of the control device of FIG. 8 for housing the poppet valve means thereof.

In particular, the movable wall 96G of the power element 54G carries a stud 742 in the central portion thereof with the stud 742 having a projection 743 adapted to be received through an opening 744 in a bimetallic disc 745 that is adapted to seat into an annular recess 746 of the spring retainer 720 as illustrated in FIG. 19.

Thus, the force of the compression spring 715 tends to move the retainer 720 toward the movable wall 96G of the power element 54G but because the bimetallic disc 745 is disposed between the spring retainer 720 and the stud 742 of the movable wall 96G of the power element 54G, the spring retainer 720 cannot abut the power element 54G. Accordingly, the expansion of the power element 54G causes the movable wall 96G to move away from the fixed wall 97G whereby such movement of the wall 96G moves the stud 742 to the left of the drawings and carries the disc 745 therewith which moves the spring retainer 720 therewith increasing the force of the compression spring 715 tending to seat the valve member 58G against the valve seat 36G whereby if the valve member 58G is in an open condition thereof, such closing movement is resisted by the force of the spring 716 until the force of the spring 715 overcomes the force of the spring 716 to permit closing of the valve member 58G. Such closing of the valve member 58G will occur when the temperature of the oven reaches or slightly exceeds the selected temperature as selected by the selector 76G in the manner previously described. Conversely, a decrease in the temperature of the oven below the selected temperature will cause the power element 54G to collapse sufficiently so that the force of the spring 716 can overcome the force of the spring 715 to thereby cause the shaft 90G to open the valve member 58G relative to the valve 36G in the manner previously described to direct fuel to the main burner means of the oven to increase the temperature thereof to the selected temperature.

Thus, it can be seen that the spring 715 directly interconnects the movable wall 97G of the power element 54G to the valve disc 58G to control the operation thereof, the compression spring 716 also cooperating with the spring 715 to control the operation of the valve disc 58G in the manner previously described.

Figure 14:
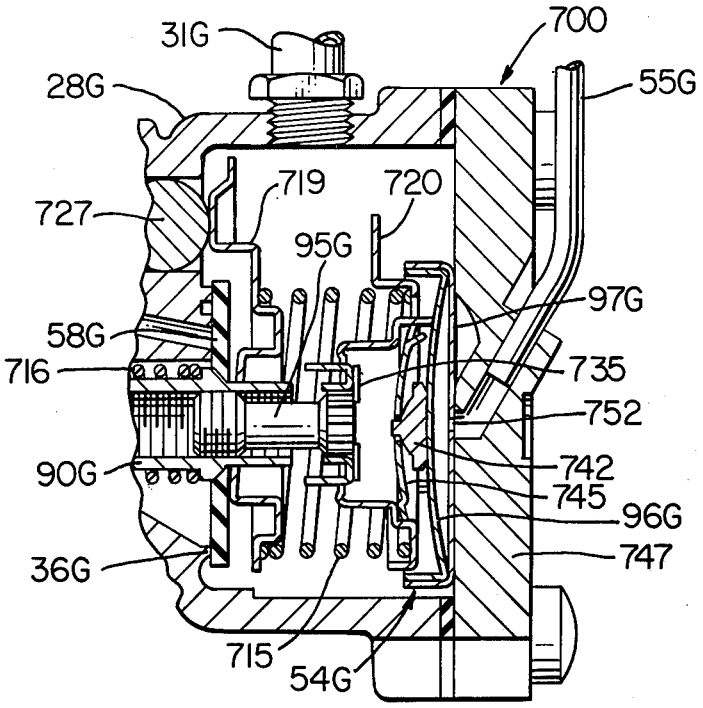
FIG. 14 is a view similar to FIG. 9 and illustrates the operation of the ambient temperature compensating means of the control device of FIG. 8.

Should an increase in ambient temperature cause the power element 54G to expand in an attempt to move the valve member 58G toward the valve seat 36G, the bimetallic disc 745 is so constructed and arranged that the same likewise will bow through the heating thereof by the change of the ambient temperature in the manner illustrated in FIG. 14 to take up such expansion of the power element 54G. Conversely, should a collapse of the power element 54G take place through a decrease in the ambient temperature, the bimetallic disc 745 will bow in a manner to take up such decrease in the expansion of the power element 54G so that such ambient temperature changes will not adversely affect the operation of the valve disc 58G intending to maintain the temperature of the oven at the selected temperature.

It has been found that when control devices, such as the control device 26 of FIG. 1 is horizontally mounted in a cooking apparatus, the capillary tube 55 for the power element 54 can extend directly perpendicularly out of the back plate 101 thereof for properly locating the temperature sensing bulb 56 in the oven of the cooking apparatus. However, when the control device 26 of FIG. 1 is to be mounted vertically in the cooking apparatus, the capillary tube 55 must be bent at an angle so as to extend substantially parallel to the plate 101 for locating the bulb 56 in the oven and it has been found that the arrangement 104 and 99 for fastening the power element 54 in the control device 26 does not provide sufficient room for permitting the bending of the capillary tube 55 so as to be parallel to the back plate 101 whereby a different power element 54 and its assembly must be utilized with the housing 28 to permit the control 26 to be mounted vertically.

However, it has been found according to the teachings of this invention that the power element arrangement or assembly 700 for the control device 26G will readily permit the control device 26G to be mounted either horizontally or vertically without a change in the parts thereof.

In particular, the power element assembly 700 of this invention includes a relatively thick metallic end plate 747 detachably secured to the housing 28G to close the opening 747′ thereof at the right hand end of the housing 28G, the plate 747 having opposed flat parallel sides 748 and 749 with a passage means 750 passing through the sides 748 and 749 in such a manner that the passage 750 extends angularly out of an angularly formed part 751 of the side 749 and substantially centrally out of the side 748 to be disposed in fluid communication with the interior of the power element 54G through an opening 752 formed through the fixed wall 97G of the power element 54G. The fixed wall 97G of the power element 54G is welded or otherwise secured to the side 748 of the plate 747 whereby the power element 54G is carried by the plate 747.

Thus, it can be seen in FIGS. 8 and 9 that the flat surface 751 of the manifold 747 has a part thereof extending into the side 749 and another part thereof extending outwardly from that side 749 approximately the same distance that the part thereof extends into the side 749.

In this manner, a rather long portion 753 of the capillary tube 55G can be angularly inserted into the passage 750 of the plate 747 as illustrated in FIG. 9 and can be welded or brazed therein, the heat sink characteristics of the relatively large plate 747 preventing the welding or brazing material from clogging the passage 750 as a sufficient portion 753 of the tube 55G can be inserted into the interior of the plate 747 so that the welding material will solidify before the same reaches the extreme end 754 of the capillary tube 55G to seal off the same.

In this manner, the capillary tube 55G external of the wall 749 can be bent as illustrated in full lines in FIG. 9 to be parallel with the wall 749 to permit the control device 26G to be mounted in a vertical position relative to the cooking apparatus or can be bent as illustrated in dotted lines in FIG. 9 to be perpendicular to the wall 749 for being mounted horizontally in the cooking apparatus.

Thus, it can be seen that one power element assembly 700 can be provided for the control device 26G to readily permit the same to be adapted for vertical or horizontally mounting of the same whereas two different power element assemblies have to be provided for the control device 26 and thereby require the double stocking of parts, etc.

Figure 22:
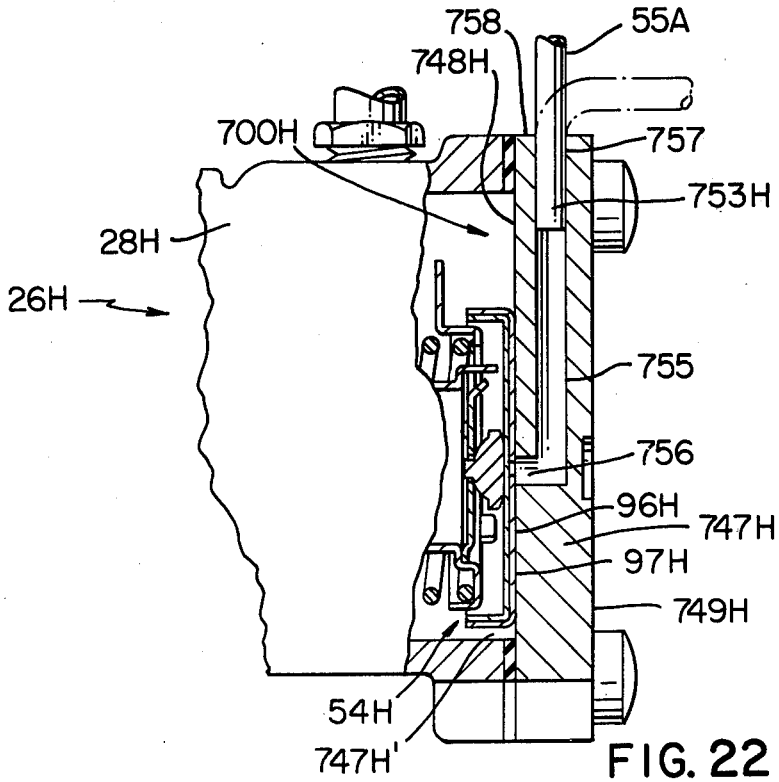
FIG. 22 is a view similar to FIG. 9 and illustrates another embodiment of the control device of this invention.

Another power element assembly of this invention is generally indicated by the reference numeral 700H in FIG. 34 for a control device 26H whereby the parts of the control device 26H of FIG. 22 that are similar to parts previously described will be indicated by like reference numerals followed by the reference letter "H."

As illustrated in FIG. 22, the relatively thick metallic end plate 747H of the assembly 700H has opposed flat sides 748H and 749H with the movable wall 97H of the power element 54H being secured thereto at the side 748H thereof so that the end plate 747H when secured to the housing 28H will close the rear opening 747H' thereof as previously described.

The plate 747H has a passage 755 formed therein in such a manner that one end 756 of the passage 755 centrally interrupts the surface 748H to be in fluid communication with the chamber between the walls 96H and 97H of the power element 54H while the other end 757 of the passage 755 passes parallel between the surfaces 748H and 749H to interrupt an end surface 758 of the plate 747H as illustrated in FIG. 22.

In this manner, the long portion 753H of the capillary tube 55H can be inserted vertically downwardly into the passage 755 at the end wall 758 a sufficient distance so that the same can be welded or brazed therein in such a manner that any molten brazing or welding material will sufficiently solidify through the heat sink properties of the plate 747H before the same reach the end 754H of the capillary tube 55H to clog the same.

Thus, the plate 747H readily permits the capillary tube 55H to extend parallel to the surface 748H and 749H in the manner illustrated in full lines in FIG. 34 to vertically mount the control device 26H or permits the capillary tube 55H externally of the plate 747H to be bent substantially perpendicular to the surface 749H in the manner illustrated in dotted lines in FIG. 22 for horizontally mounting the control device 26H.

Accordingly, it can be seen that the assemblies 700 and 700H readily permit their respective control devices 26G and 26H to be mounted either vertically or horizontally without requiring a changing of parts of the power elements 54G and 54H as in the control device 26 previously described.

Thus, it can be seen that this invention not only provides improved fuel control devices, but also this invention provides a fuel control system utilizing such control devices or the like.

While the forms of the invention now preferred have been described and illustrated as required by the Patent Statute, it is to be understood that other forms may be utilized and still come within the scope of the appended claims.

What is claimed is:

1. In a fuel control device having a valve means to be thermostatically controlled by an expandable and contractible power element having a movable wall for operating said valve means and a fixed wall for being carried by said control device, the improvement comprising a one-piece relatively thick manifold having opposed substantially flat parallel sides, said manifold being secured to said device and having passage means therethrough leading from one of said sides of said manifold external to said control device to the other of said sides of said manifold internal of said control device, said power element having said fixed wall secured to said other side of said manifold to be carried thereby and be in fluid communication with said passage means thereof, said one side of said manifold having a substantially flat external surface disposed at an angle relative to said one side other than parallel and being interrupted by said passage means, said flat surface having a part thereof extending into said one side of said manifold and another part thereof extending outwardly from said one side approximately the same distance said part of said flat surface extends into said one side, and a conduit means secured in said passage means at said flat external surface of said one side of said manifold to be carried thereby and be in fluid communication with said passage means thereof.

2. A fuel control device as set forth in claim 1 wherein said control device has a housing means provided with an opening in one end thereof, said manifold closing said opening when said manifold is secured to said control device.

3. A fuel control device as set forth in claim 1 wherein said conduit means is bent adjacent said flat external surface of said manifold to extend substantially parallel to said one side of said manifold.

4. A fuel control device as set forth in claim 1 wherein said conduit means is bent adjacent said flat external surface of said manifold to extend substantially perpendicular to said one side of said manifold.

* * * * *